US009025773B2

(12) United States Patent
Whitecar et al.

(10) Patent No.: US 9,025,773 B2
(45) Date of Patent: May 5, 2015

(54) UNDETECTABLE COMBINING OF NONALIGNED CONCURRENT SIGNALS

(75) Inventors: John Elliott Whitecar, Plymouth, MI (US); Trudy D. Stetzler, Houston, TX (US)

(73) Assignee: Texas Instruments Incorporated, Dallas, TX (US)

( * ) Notice: Subject to any disclaimer, the term of this patent is extended or adjusted under 35 U.S.C. 154(b) by 444 days.

(21) Appl. No.: 13/452,864

(22) Filed: Apr. 21, 2012

(65) Prior Publication Data

US 2013/0279700 A1 Oct. 24, 2013

(51) Int. Cl.
*H04H 20/48* (2008.01)
*H04H 20/22* (2008.01)
*H04H 60/12* (2008.01)

(52) U.S. Cl.
CPC ..... *H04H 60/12* (2013.01); *H04H 20/22* (2013.01)

(58) Field of Classification Search
CPC ... H04H 2201/60; H04H 20/34; H04H 20/26; H04H 20/18; H04L 25/38
USPC ..... 381/3, 94.4, 94.5; 375/340, 295, 150, 375/224; 455/133, 161
See application file for complete search history.

(56) References Cited

U.S. PATENT DOCUMENTS

| | | | | |
|---|---|---|---|---|
| 6,590,944 | B1 * | 7/2003 | Kroeger | 375/340 |
| 8,538,038 | B1 * | 9/2013 | Lester | 381/94.5 |
| 2002/0115418 | A1 * | 8/2002 | Wildhagen | 455/133 |
| 2003/0189989 | A1 * | 10/2003 | Kroeger | 375/295 |
| 2006/0019601 | A1 * | 1/2006 | Kroeger et al. | 455/3.06 |
| 2008/0212794 | A1 * | 9/2008 | Ikeda | 381/94.1 |
| 2008/0298440 | A1 * | 12/2008 | Kroeger et al. | 375/150 |
| 2010/0027719 | A1 * | 2/2010 | Pahuja | 375/340 |
| 2010/0302083 | A1 * | 12/2010 | Helfenstein et al. | 341/118 |
| 2011/0111714 | A1 * | 5/2011 | Balakrishnan et al. | 455/161.3 |
| 2013/0003637 | A1 * | 1/2013 | Elenes et al. | 370/312 |
| 2013/0003801 | A1 * | 1/2013 | Elenes et al. | 375/224 |
| 2013/0262129 | A1 * | 10/2013 | Choi et al. | 704/500 |

* cited by examiner

*Primary Examiner* — Xu Mei
*Assistant Examiner* — Ubachukwu Odunukwe
(74) *Attorney, Agent, or Firm* — Robert D. Marshall, Jr.; Frank D. Cimino

(57) ABSTRACT

The approach shown provides for an efficient implementation of time response, level response and frequency response alignment between two audio sources such as DAB and FM that may be time offset from each other by as much as 2 seconds, and produces an aurally undetectable transition between the sources. Computational load is significantly reduced over the approaches known in the prior art.

7 Claims, 2 Drawing Sheets

UNDETECTABLE COMBINING OF NONALIGNED CONCURRENT SIGNALS

TECHNICAL FIELD OF THE INVENTION

The technical field of this invention is audio processing in general, and transparent blending of non aligned concurrent audio signals in particular.

BACKGROUND OF THE INVENTION

DAB stands for Digital Audio Broadcasting and is a method for the terrestrial digital transmission of radio signals. DAB allows for a much more efficient use of frequency spectrum than traditional analog radio. Instead of just one service per frequency as is the case on FM, DAB permits up to nine (or more) services on a single frequency.

Multipath propagation interference that commonly disturbs analog reception, is caused by radio signals bouncing off buildings and hills, and is eliminated with DAB signals. Since DAB automatically selects the strongest regional transmitter, reception is much clearer.

Immunity to fading and interference caused by multipath propagation is achieved without equalization by means of the OFDM modulation techniques.

OFDM modulation consists of 1,536 subcarriers that are transmitted in parallel. The useful part of the OFDM symbol period is 1 millisecond, which results in the OFDM subcarriers each having a bandwidth of 1 kHz due to the inverse relationship between these two parameters, and the overall OFDM channel bandwidth is 1,537 kHz. The OFDM guard interval is 246 microseconds, which means that the overall OFDM symbol duration is 1.246 milliseconds. The guard interval duration also determines the maximum separation between transmitters that are part of the same single-frequency network (SFN), which is approximately 50 miles.

OFDM allows the use of single-frequency networks (SFN), which means that a network of transmitters can provide coverage to a large area—up to the size of a country—where all transmitters use the same transmission frequency. Transmitters that are part of an SFN need to be very accurately synchronized with other transmitters in the network, which requires the transmitters to use very accurate clocks.

When a receiver receives a signal that has been transmitted from the different transmitters that are part of an SFN, the signals from the different transmitters will typically have different delays, but to OFDM they will appear to simply be different multipaths of the same signal. Reception difficulties can arise, however, when the relative delay of multipaths exceeds the OFDM guard interval duration.

While DAB is commonly used in parts of the world, it is a relatively new transmission method. Coverage is still limited, and availability of the appropriate receivers is limited as well.

In order to provide complete coverage, it is a common procedure to simultaneously transmit or simulcast program material using both DAB and analog Frequency Modulated (FM) signals. DAB receivers are usually also capable of receiving both DAB and FM transmissions.

Since DAB receivers are commonly used in automobiles or other moving applications, there is a need to be able to seamlessly switch between the two transmission modes as the receiver moves between different transmission areas. The audio degradation modes of the two transmission modes is also different, so it is beneficial for the receiver to be able to select the transmission that has the best audio quality at any given time.

There are multiple methods known in the prior art to accomplish this goal. The following examples illustrate some of the known methods.

A) Simple switching—a decision is made in the receiver that determines which signal has a better quality, and that is selected by a simple transfer switch. This method may result in gaps in the audio due to the misalignment of the signals.

B) Simple blending—a decision is made in the receiver that determines which signal has a better quality, and the signals are mixed and ramped from one signal to the other without any time alignment. This may result in "confused" audio during the ramping due to time misalignment of the signals.

C) Sample correlation time alignment—a decision is made in the receiver that determines which signal has a better quality. After performing a sample by sample time alignment correlation, the signals are mixed and gain is ramped from one signal to the other. While this method will result in good audio quality, it is also very computationally intensive.

SUMMARY OF THE INVENTION

When DAB and FM broadcasts transmit simulcast programs, there is a need to dynamically determine the best audio signal and unperceptively switch between the sources. Unfortunately, there is no guarantee of time alignment, level alignment or frequency response between the various sources.

Most DAB systems today do not blend to FM at all and those that do create obvious discontinuities when switching between the two sources. The approach shown addresses the primary areas of signal discontinuity when transitioning between two non aligned signal sources with nominally the same broadcast material.

This approach provides for an efficient implementation of time, level and frequency response alignment between the two sources that produces an undetectable transition between the two sources. Efficiency is gained through taking advantage of the particular statistics of the signals involved and applying optimized techniques to exploit these advantages.

BRIEF DESCRIPTION OF THE DRAWINGS

These and other aspects of this invention are illustrated in the drawings, in which.

DETAILED DESCRIPTION OF PREFERRED EMBODIMENTS

Figure 1:
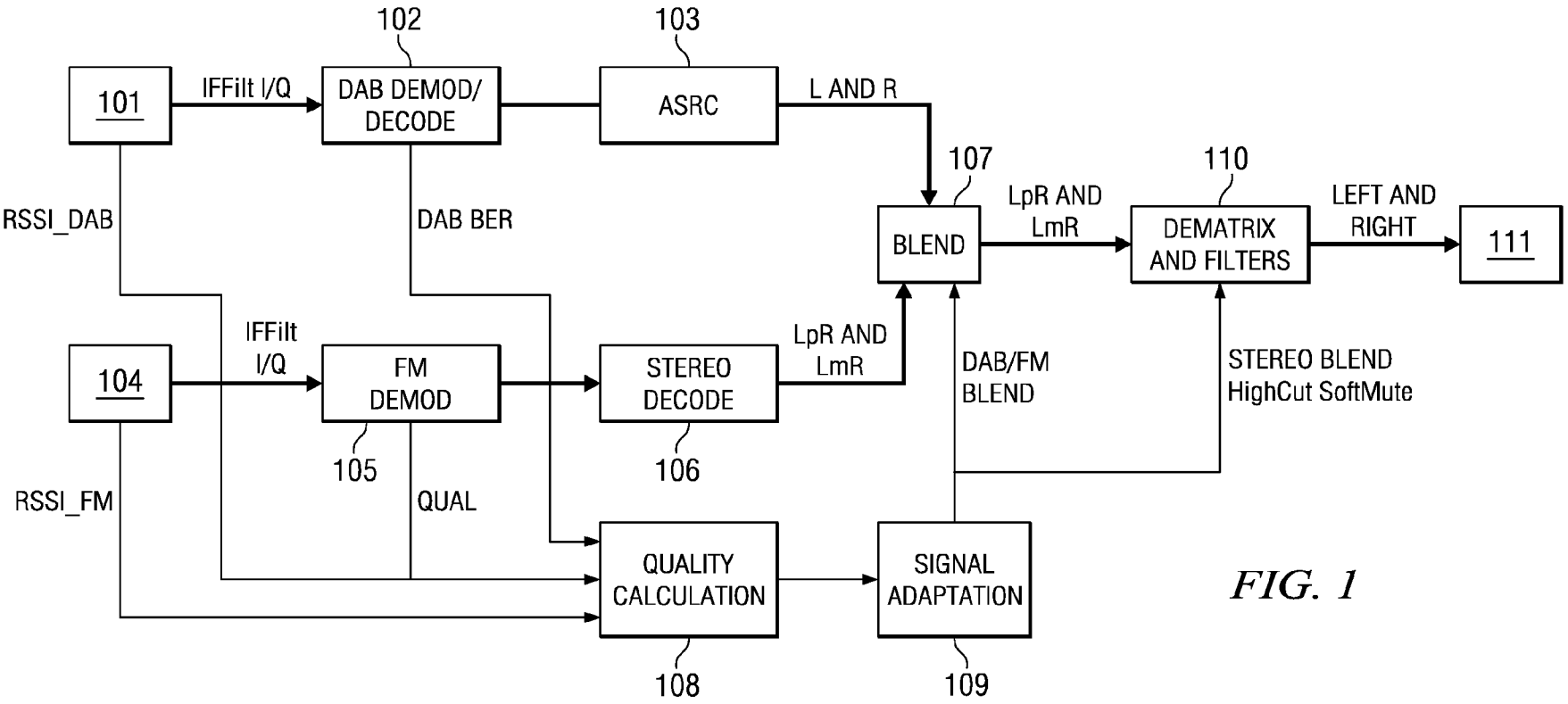
FIG. 1 is a block diagram of one implementation of seamless audio blending.

FIG. 1 illustrates one embodiment of the invention. The DAB and FM signals are received by blocks 101 and 104 respectively. The DAB signal is demodulated and decoded in block 102, while the FM signal is demodulated in block 105. The DAB signal is then sample rate adjusted and filtered, by the Asynchronous Sample Rate Converter (ASRC) in block 103, while the demodulated FM signal is stereo decoded in block 106. The resultant left and right stereo signals from the two sources are then blended in blocks 107 and 110. The blending step is controlled by the quality calculation performed in block 108 and in the signal adaptation block 109.

The quality calculations governing the blending process are based on signals from the preceding blocks. These signals are the Radio Frequency Signal Strength Indicators (RSSI) from blocks 101 and 104, the DAB Bit Error Rate (BER) from the DAB demodulate/decode block 102 and the Quality indicator from the FM demodulate block 105.

Block 111 completes the processing by performing the required output gain adjustments.

Figure 2:
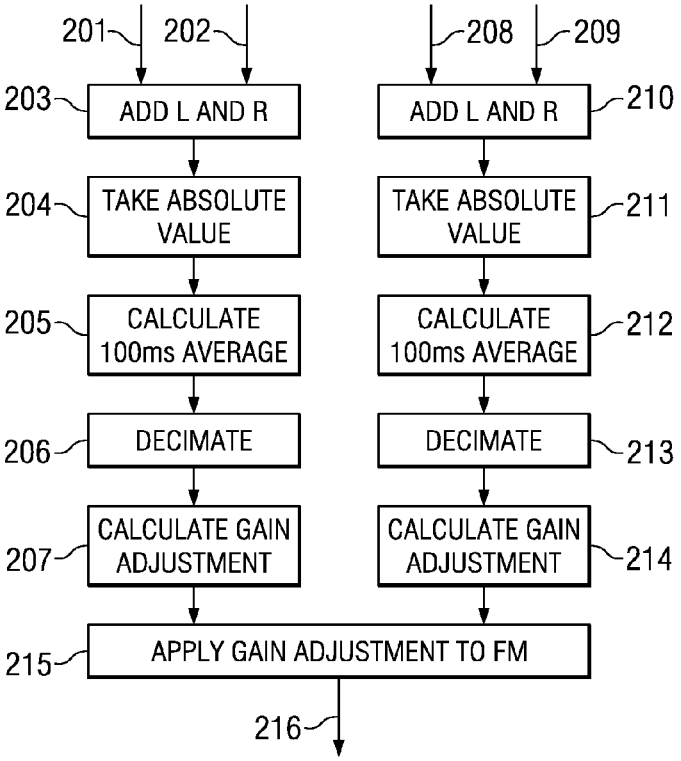
FIG. 2 is a flow chart showing an example of the gain adjust algorithm.

FIG. 2 shows one implementation of the gain match algorithm. Input 201 is the left DAB signal, and input 202 is the right DAB signal. In order to monitor the envelope of the monaural DAB signal the left and right components are added in block 203, and the absolute value of the sum is calculated in block 204.

TI-70751

DAB audio=DAB_Left+DAB_Right

DAB_envelope=ABS[DAB_audio]

Block 205 then calculates the average DAB envelope over a 100 ms time span.

DAB_Envelope_Avg=(1−α)*DAB_Envelope_Avg+α*DAB_envelope

Where Ts*(1−α)/α~0.1

Similarly for the FM signal, the FM left and FM right signals on respective inputs 208 and 209 are summed in block 210, and the absolute value is calculated in block 211.

FM_audio=FM_Left+FM_Right

FM_envelope=ABS[FM_audio]

Block 212 then calculates the average FM envelope over a 100 ms time span.

FM_Envelope_Avg=(1−α)*FM_Envelope_Avg+α*FM_envelope

Where Ts*(1−α)/α~0.1

The resulting DAB and FM envelope signals are then decimated in respective blocks 206 and 213, and the required gain adjustment is calculated in blocks 207 and 214.

DAB_Envelope_Level=(1−β)*DAB_Envelope_Level+β*DAB_envelope_Avg

FM_Envelope_Level=(1−β)*FM_Envelope_Level+β*FM_envelope_Avg

Where Ts*10*(1−β)/β~1.0; Measure average level over 1000 ms

The gain adjustment thus calculated is then applied to the FM signal in block 215

FM_Gain_Adj=DAB_Envelope_Level/FM_Envelope_Level

FM_audio=FM_Gain_Adj*FM_audio

Once the envelope signals are gain matched, the time delay between the DAB and the FM signals must be determined. This may be done through cross correlation. Since the envelope signals are low pass filtered, the signals may be decimated to a low rate to minimize the computational load required for cross correlation.

The decimated DAB and FM envelope signals are stored in circular buffers of sufficient length to handle the worst case expected time delay between the two signals with the assumption that the DAB signal will be trailing the FM signal due to processing delays in the transmitter and receiver, as well as transport delays from the audio source. The correlation is calculated as follows:

Audio_Corr=$\Sigma^K$[FM_Envelope_Avg[n]*DAB_Envelope_Avg[n−k]];

Where K=#samples to cover worse case time delay (~2 sec at 1 ksp=2000 samples)

The index max(Audio_corr) determines the time delay between the FM and DAB audio signals, and this index is then used to set the read point for the FM signal from the buffer.

The blending of the DAB and FM signals is controlled by the quality indicators derived from information in the DASB and FM receivers/tuners. In the case of DAB, these indicators are:

RSSI (RF Signal Strength Indicator)

BER (Bit Error Rate)

For the FM signal, the following quality indicators are available:

RSSI (RF Signal Strength Indicator)

Noise

Adjacent Channel Interference

Multipath Interference

A quality of Service (QOS) indicator may be calculated for the DAB and FM signals, and may be used in the blending process. A threshold is set representing the minimum acceptable QOS value, and the blending is performed as follows:

if DAB_QOS<either threshold, DAB_FM_Blend=FM else DAB_FM_Blend=DAB

Figure 3:
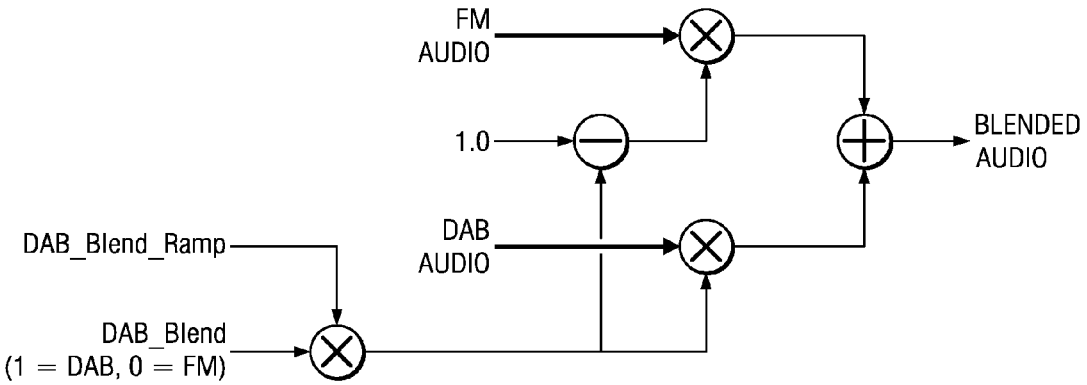
FIG. 3 illustrates the DAB and FM blending process.

Essentially, if DAB quality is sufficient the audio will remain in DAB mode, otherwise switch to the FM mode for more consistent audio performance. One implementation of the blending process is illustrated in FIG. 3.

What is claimed is:

1. A method of undetectable blending of a Digital Audio Broadcast transmission first audio source and a Frequency Modulate transmission second audio source comprising the steps of:

calculating an average envelop value of the first audio source over a time span Ts as follows:

DAB audio=DAB_Left+DAB_Right,

DAB_envelope=ABS[DAB_audio], and

DAB_Envelope_Avg=(1−α)*DAB_Envelope_Avg+α*DAB_envelope, where: DAB_Left is a left channel of the first audio source; DAB_Right is a right channel of the first audio source; and α is selected whereby Ts*(1−α)/α~0.1;

downsampling the average envelop value of the first audio source;

calculating an average envelop value of the second audio source over the time span Ts as follows:

FM_audio=FM_Left+FM_Right,

FM_envelope=ABS[FM_audio], and

FM_Envelope_Avg=(1−α)*FM_Envelope_Avg+α*FM_envelope, where: FM_Left is a left channel of the second audio source; and FM_Right is a right channel of the second audio source;

downsampling the average envelop value of the second audio source;

calculating a gain adjustment for the first audio source;

calculating a gain adjustment for the second audio source;

applying gain adjustment to the second audio source;

calculating a time delay between the first audio source and the second audio source;

calculating a Quality of Service (QOS) indicator for said first and second audio source using quality indicators provided by said audio sources;

blending the first audio source and the second audio source offset by the calculated time delay based upon the Quality of Service indicator.

2. The method of claim 1, wherein:

said step of calculating a gain adjustment for the first audio channel calculates:

DAB_Envelope_Level=(1−β)*DAB_Envelope_Level+β*DAB_envelope_Avg where: β is selected whereby Ts*10*(1−β)/β~1.0.

3. The method of claim 1, wherein:

said step of calculating a gain adjustment for the second audio channel calculates:

$$FM_Envelope_Level=(1-\beta)*FM_Envelope_Level+\beta*FM_envelope_Avg$$

where: $\beta$ is selected whereby $Ts*10*(1-\beta)/\beta\sim1.0$.

4. The method of claim 1, wherein:

said step of applying gain adjustment to the second audio signal operates as follows:

$FM_Gain_Adj=(DAB_Envelope_Level)/(FM_Envelope_Level)$, $FM_audio=FM_Gain_Adj*FM_audio$.

5. The method of claim 1, wherein:

said step of calculating a time delay between the first audio channel and the second audio channel includes calculating a correlation for each value k from a worse case time delay to 0:

$$Audio_Corr=\Sigma^{K}[FM_Envelope_Avg[n]*DAB_Envelope_Avg[n-k]];$$

determining a value k yielding a maximum Audio_Corr;

determining the time delay corresponding to the value k yielding the maximum Audio_Corr.

6. The method of claim 1, wherein:

said step of blending the first audio source and the second audio source offset by the calculated time delay includes setting a minimum acceptable Quality of Service indicator thresholds for said first and second audio source, selecting a preferred audio source as follows:

if DAB_QOS<either threshold, then DAB_FM_Blend=FM offset by time delay k, else DAB_FM_Blend=DAB.

7. The method of undetectable blending of two audio sources of claim 1 further comprising the steps of:

buffering said envelope signals from said first and second audio source in two circular buffers of sufficient length to hold the signals during the worse case time delay.

* * * * *